US006530717B1

(12) United States Patent
Bergamaschi

(10) Patent No.: US 6,530,717 B1
(45) Date of Patent: Mar. 11, 2003

(54) MECHANISM FOR LOCKING ROLL UP CURTAINS AND THE LIKE

(75) Inventor: Giovanni Bergamaschi, Bologna (IT)

(73) Assignee: Sunproject Canada Inc., Ontario (CA)

( * ) Notice: Subject to any disclaimer, the term of this patent is extended or adjusted under 35 U.S.C. 154(b) by 0 days.

(21) Appl. No.: 09/561,131

(22) Filed: Apr. 28, 2000

(30) Foreign Application Priority Data

May 4, 1999 (CA) ..... 2270682

(51) Int. Cl.[7] ..... E06B 9/208; E06B 9/56; E06B 9/20

(52) U.S. Cl. ..... 403/325; 403/102; 403/105; 160/319; 160/298

(58) Field of Search ..... 160/316, 318, 160/319, 298; 185/13, 43; 403/102, 105, 325

(56) References Cited

U.S. PATENT DOCUMENTS 65,067 A * 5/1867 Fowler ..... 160/298
102,344 A * 4/1870 Whitney ..... 160/298
881,196 A * 3/1908 McCall ..... 160/298
3,211,212 A * 10/1965 Smith ..... 160/298
4,534,396 A * 8/1985 Jung ..... 160/319
4,751,953 A * 6/1988 Appel et al. ..... 160/321
4,905,803 A * 3/1990 Boyd ..... 192/217.1
5,167,269 A * 12/1992 Abo ..... 160/321
5,375,643 A * 12/1994 Rude ..... 160/321
5,443,109 A * 8/1995 Benthin ..... 160/319
5,488,983 A * 2/1996 Jung ..... 160/319
6,158,563 A * 12/2000 Welfonder et al. ..... 160/319

* cited by examiner

*Primary Examiner*—Lynne H. Browne
*Assistant Examiner*—Ernesto Garcia
(74) *Attorney, Agent, or Firm*—William J. Sapone; Coleman Sudol Sapone, P.C.

(57) ABSTRACT

In a mechanism for locking curtains and the like, a sleeve rotates about a relative axis and is fastened to a roll, in coaxial relation therewith. A curtain is rolled up on the roll. A barrel features at least one radial housing opening outside of the barrel and enters freely the sleeve. The mechanism includes also one spring introduced freely in each radial housing and pushing a cylinder or a sphere against an inner surface of the sleeve.

24 Claims, 3 Drawing Sheets

FIG. 1
PRIOR ART
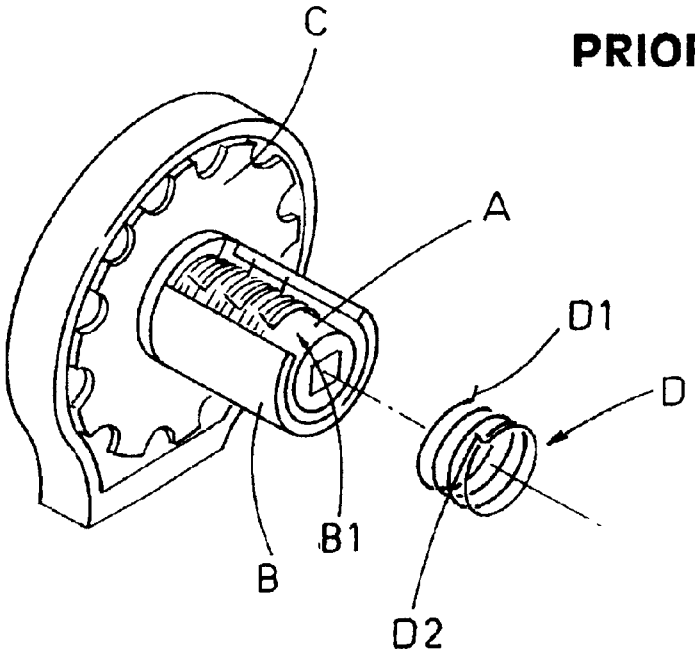
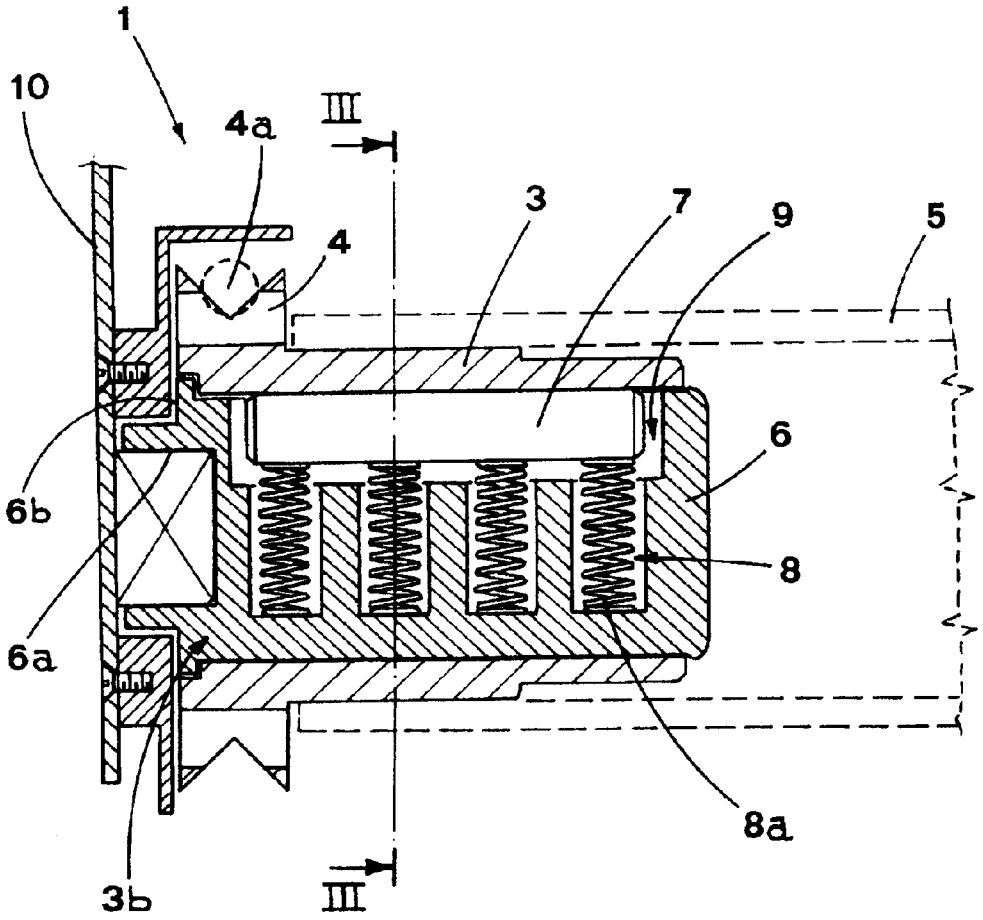
FIG. 2a

FIG. 7
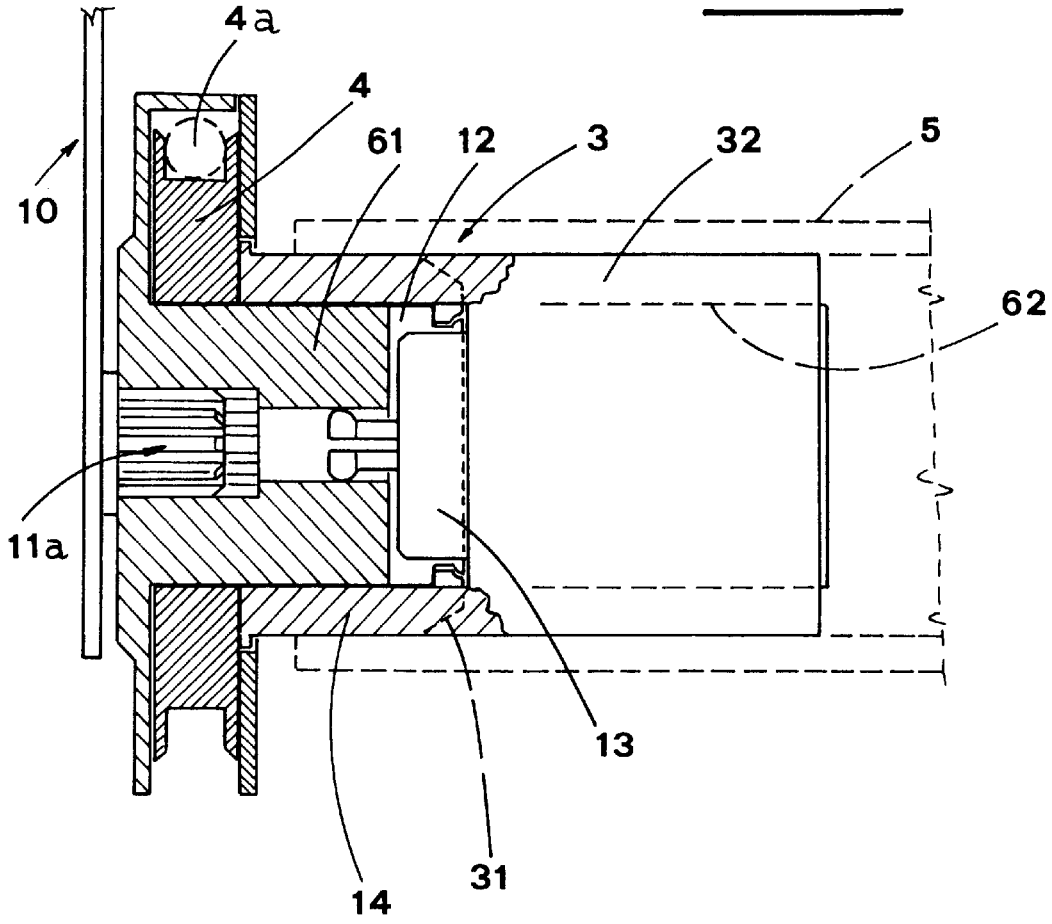
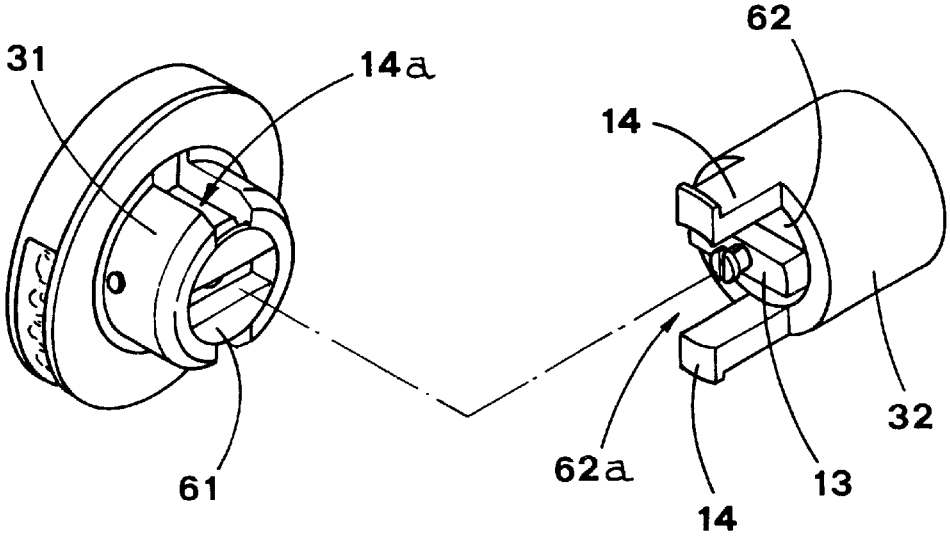
FIG. 8

MECHANISM FOR LOCKING ROLL UP CURTAINS AND THE LIKE

BACKGROUND OF THE INVENTION

The present invention relates to the production of darkening and protection devices for windows or doors, e.g. curtains or mosquito nets, these curtains or nets rolling and unrolling on a cylinder structure.

In particular, the present invention relates to a mechanism for locking the curtains or mosquito nets in a desired position, usually open or closed, but mainly in any intermediate position.

DESCRIPTION OF THE PRIOR ART

Devices have heretofore been provided, as including a roll, on which the curtain or mosquito net rolls up, supported by suitable, substantially horizontal means.

This roll is usually introduced in a suitable case situated over, or in any case, near the upper edge of the window or door.

The free end of the curtain goes out of said case through a relative slot.

The curtain can be operated by a suitable drive member, basically including a pulley, which is integral with the roll and is connected to a relative, generally endless pull rope going out of the case at the sides of the pulley.

The roll is driven into rotation in the rolling direction by pulling down one of the rope ends, whereas it is driven into rotation in the unrolling direction by pulling down the other of the rope ends.

Suitable locking means, usually connected to the roll, allow the curtain to be firmly positioned, approximately in the desired point.

The main disadvantage of these locking mechanisms derives from the fact that they are not sufficiently resistant, when the curtain moves, either in rolling or unrolling direction.

These locking mechanisms must offer a sufficient resistance when the curtain is motionless, so as to maintain it in the predetermined position, overcoming possible action of elastic means connected to the roll, which would tend to roll it.

This locking mechanism can be formed by brakes, which elastically interfere with a support fastened to the roll on which the curtain is positioned.

The dimension of the brakes, wound around a suitable blocking part, prevents roll free rotation, if the curtain is not stressed from outside.

Other devices have been proposed, as shown in FIG. 1, in which the curtain control means C feature a hollow roll B, coaxial therewith, which has, made therealong, a slit B1 cooperating with the ends D1, D2 of a plurality of elastic means D, freely wound around an inner roller A, stationary and coaxial with the hollow roll B.

When suitable transmission means drive the control means C to rotate, the edges of the slit B1 go in abutment against the ends D1, D2 of the elastic means D, thus twisting them.

When one of the edges of the slit B1 strikes the related end D1 or D2 respectively, the friction of the elastic means D, wound around the inner roller A and sliding therealong, is reduced, thus facilitating the curtain rolling and unrolling.

If the control means C are not operated by the user, the action of the elastic means D on the inner cylinder A determines a friction against mutual sliding, and the friction action is bigger than the weight action of the portion of the curtain not wound around the hollow roll B.

The above mentioned technical solutions are worldwide marketed, yet they have a very big drawback resulting from a considerable unreliability of the curtain positioning.

This unreliability is a direct consequence of the difference between the circumference arc corresponding to the transversal dimension of the slit B1 and the distance between the ends D1, D2 of the elastic means D; this is a problem particularly in case of mosquito nets.

Moreover, the more stressed components, in particular the edges of the slit B1 of the hollow roll B and the ends D1, D2 of the elastic means D, lack structural resistance.

If the locking mechanism maintenance, which is very expensive, is not proper, a structural deficiency of the hollow roll B in the slit B1 area can seriously jeopardize the locking mechanism functionality, thus damaging its reliability.

Moreover, it is to be pointed out that the described technical solutions are obtained by using very expensive components and specialized manpower.

In fact, the cost of this mechanism depends on its dimension, which is related to the curtain dimensions.

Further, it is necessary to prepare a wide range of sizes for satisfying the market different needs.

SUMMARY OF THE INVENTION

This invention was evolved with the general object of avoiding the above mentioned drawbacks by proposing a mechanism for locking curtains and the like which guarantees a rapid, precise and stable locking in any position and in any angular position of the curtain supporting roll.

Another object of the present invention is to propose a locking mechanism, which is particularly strong and reliable in different working conditions.

A further object of the present invention is to propose a considerably versatile locking mechanism, which has almost the same size for curtains and nets of different dimensions.

Yet another object is to propose a locking mechanism obtained by a simple technical solution, which guarantees correct rolling and unrolling and which is extremely functional, reliable and cheap.

The above mentioned objects are obtained, in accordance with the contents of claims, in a mechanism for locking curtains and the like including a sleeve rotating about a longitudinal axis and fastened to a roll, in coaxial relation therewith, with a curtain or a similar article rolled up on said roll, said mechanism being fastened to a stationary support structure, by providing said mechanism with:

- a barrel which enters freely said sleeve and couples firmly with said structure by relative coupling means, with said barrel featuring, made therein, at least one radial housing opening outside of said barrel;
- at least one elastic element introduced freely in this radial housing and co-operating with friction means, said friction means being kept in contact with an inner surface of said sleeve due to the action of these friction means on the elastic element.

According to a different embodiment of the invention, the mechanism includes:

- a barrel which enters freely said sleeve and couples firmly with said structure by relative coupling means;
- a plurality of series of radial housings made in said barrel, with housings of each series all aligned and opening outside of said barrel, with corresponding axes of said housings being laid in a relative longitudinal plan passing through a longitudinal axis of this barrel;

at least one elastic element introduced freely in each radial housing and co-operating with relative friction means, said friction means being kept in contact with an inner surface of said sleeve due to the action of these friction means on the elastic element.

BRIEF DESCRIPTION OF THE DRAWINGS

The characteristic features of the present invention will become more fully apparent from the following detailed description of a preferred, but not sole, embodiment taken in conjunction with the accompanying drawings, in which:

FIG. 1 is a schematic prospective view of the device described in prior art;

FIGS. 2*a*, 2*b* are schematic lateral corresponding views in axial section of the proposed locking mechanism in two different use conditions;

FIG. 7 is a lateral, partially section view of a different conformation of the proposed device;

FIG. 8 is a schematic, perspective exploded view of two different parts of the device shown in FIG. 7.

Figure 3:
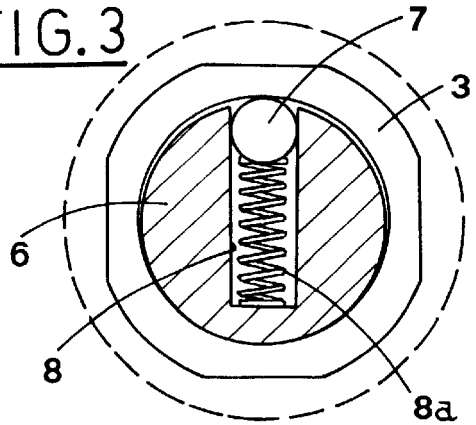
FIG. 3 is a section view taken along III—III of FIG. 2*a;*

With reference to the above mentioned drawings, the reference numeral 1 generally designates a mechanism for locking curtains and the like.

DESCRIPTION OF THE PREFERRED EMBODIMENTS

Mechanism 1 is substantially formed by a sleeve 3 featuring a ring-like seat 3*a* made thereinside, near the inlet 3*b*.

The seat 3*a* goes in abutment with a flange 6*b* of a barrel 6 introduced into the sleeve 3 coaxial therewith.

On its outer side, near the inlet 3*b*, the sleeve 3 forms a drive member 4, e.g. integral with this sleeve, which transmits a rotating motion to the sleeve 3 by a relative transmission element 4*a*, e.g. a driving rope connected to this member 4.

Figure 2B:
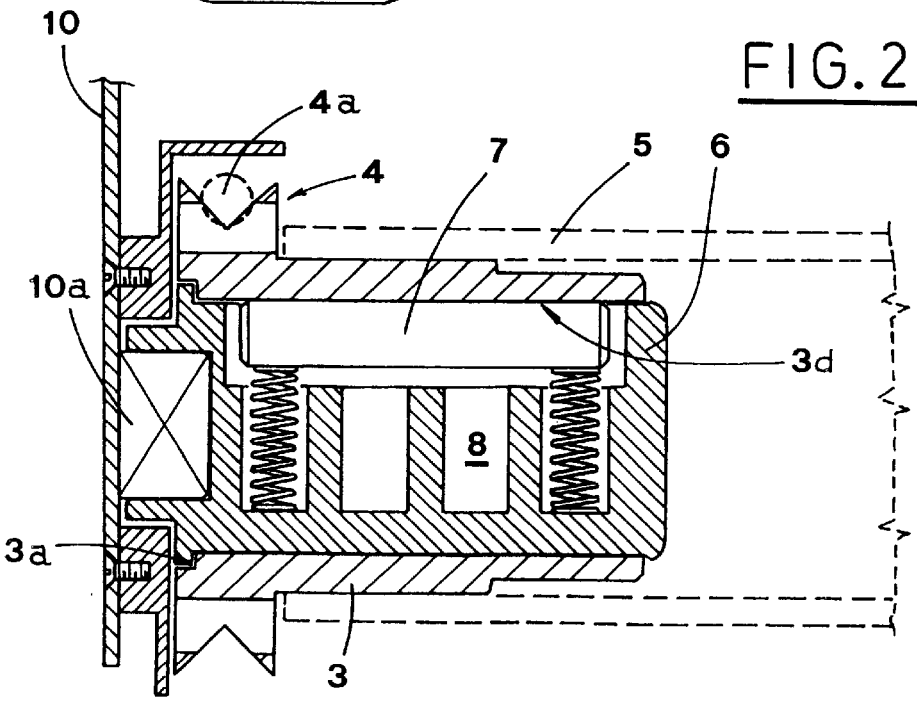

A hollow roll 5, around which a curtain is wounded, is fastened outside the sleeve 3 coaxial therewith (FIG. 2*a*).

Near its flange 6*b*, the barrel 6 is equipped with coupling means which comprise a seating 6*a*, coaxial therewith, which couples with a tang 10*a* formed by a stationary support structure, e.g. vertical (FIG. 2*a*).

The barrel 6 is provided with a plurality of radial housings 8, aligned and arranged along a longitudinal plane which include the axis of the barrel 6.

The housings 8 open in a longitudinal recess 9 made in the outer surface of the barrel 6.

Friction means 7, e.g. a cylinder, freely introduced into this longitudinal recess 9, are kept always in contact with the inner surface 3*d* of the sleeve 3 due to the elastic reaction exerted by elastic means 8*a* on these friction means.

The elastic means 8*a* are freely introduced into the radial housings 8.

Figure 4:
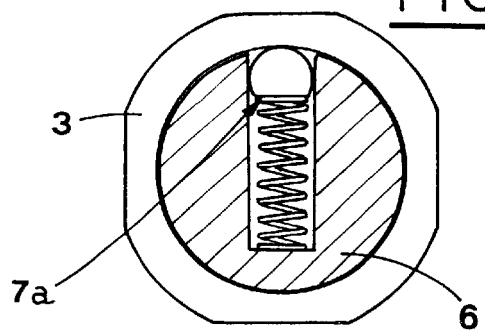
FIG. 4 is the same view of FIG. 3 of the proposed device according to another embodiment.

According to the embodiment shown in FIG. 4, this cylinder 7 features a flattening 7*a*, on which the elastic means 8*a* act.

It is possible to operate the drive member 4 by the rope 4*a* starting from any static condition of the curtain wound around the hollow roll 5, in both rolling and unrolling directions.

Rotation, thus imposed to the sleeve 3, creates a low friction relative sliding and/or rolling motion between the cylinder 7 and the inner surface 3*d* of the sleeve 3.

This effect is obtained because the barrel 6 is locked to the stationary support structure 10.

In this way, rolling and/or unrolling of the curtain, or other similar element, placed on the hollow roll 5 integral with the sleeve 3, is facilitated.

The absence of the outer pull action on the drive member 4 creates a friction which prevents relative rotation of the sleeve 3.

This is caused by elastic reaction of the elastic means 8*a*, of suitable number and of proper characteristics, which pushes the cylinder 7 against the inner surface 3*d* of the sleeve 3.

In this way, a particularly static angular condition of the sleeve 3 with respect to the barrel 6 is obtained.

This condition can be altered by acting on the drive member 4 by the rope 4*a*, in a predetermined way.

According to another embodiment, the locking mechanism includes a plurality of series of aligned radial housings 8, arranged along relative longitudinal plans all including the barrel 6 axis and angularly equispaced.

Figure 5:
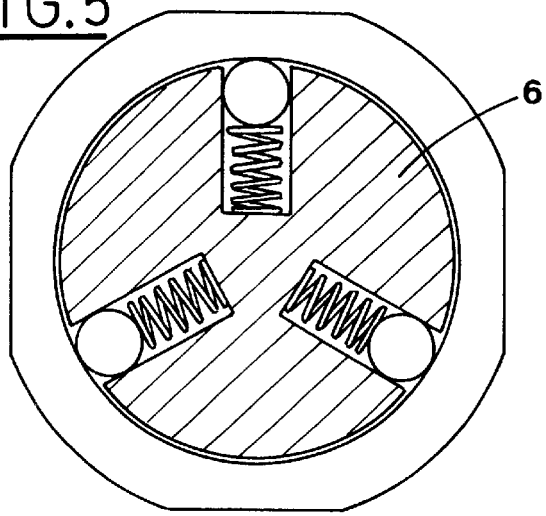
FIG. 5 is a schematic front sectional view of the device according to a further embodiment, taken along a plan perpendicular to the device axis.

The radial housings 8 of each series open in a related longitudinal recess 9 made in the outer surface of the sleeve 3 (FIG. 5).

This way, it is possible to stabilize in better way the angular configuration of the sleeve 3 and/or a sleeve 3 supporting a hollow roll 5 with a curtain of big dimensions and/or weight.

Figure 6:
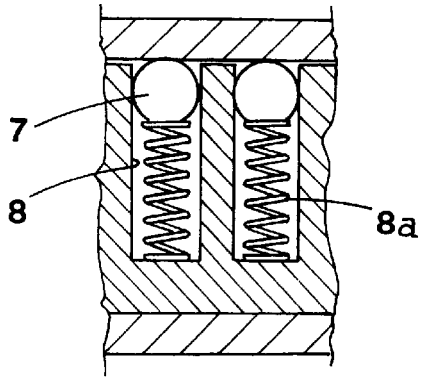
FIG. 6 is a schematic lateral view in axial section of still another embodiment of the proposed device.

According to a further embodiment of the present invention, it is possible to obtain a regular positioning precision for the curtain by providing radial housings 8, which do not open into a longitudinal recess 9, but extend up to the outer surface of the barrel 6 (FIG. 6).

In this case, the most proper friction means 7 are spheres kept permanently in contact with the inner surface 3*d* of the sleeve 3 by the elastic reaction of the elastic means 8*a*.

Likewise, series of aligned radial housings 8 can be provided, arranged along relative longitudinal plans all including the barrel 6 axis and angularly equispaced.

According to a possible construction, the barrel 6 includes two bodies, an anchorage body 61 and an operative body 62, which can be removably fastened to each other (FIGS. 7, 8).

In this case, the anchorage body 61 has coupling means which mesh with the support structure 10, in a known way, by a splined coupling 11*a* having grooved profiles provided with the support structure for entering a seating having a complimentary section made in the anchorage body portion of the barrel.

The anchorage body 61 features also a transversal slot 12, made along an axial symmetry plane.

The operative body 62 includes a unit 13, situated in the region of the coupling head 62*a* and having a profile complementary to the transversal slot 12 into which it is introduced.

Likewise, the sleeve 3 is formed by two bodies, a reference body 31 and a support body 32, which can be removably locked to each other.

The reference body 31 winds freely and tightly around the anchorage body 61 and is integral with the drive member 4.

This reference body 31 has also a pair of longitudinal grooves 14*a*, e.g. facing opposite directions, which couple with a corresponding pair of wings 14, formed by the support body 32.

The assembly constituted by the operative body 62 and the part of the support body 32, without considering the wings 14, is manufactured according to any one of the described embodiments, shown in FIGS. from 1 to 6.

Basically, while the reference body 31 rotates with respect to the anchorage body 61, the support body 32, driven by the reference body 31, rotates with respect to the corresponding operative body 62.

Once the anchorage body 61 has been fastened to the support structure 10, this solution allows a rapid and best mounting of the operative body 62 and the complementary support body 32 introduced into the relative head of the hollow roll 5.

This way, when the barrel and the sleeve are coupled with the hollow roll 5, they are not subjected to dangerous bending stresses, particularly in case of very big, and consequently heavy, curtains and the like.

The described locking mechanism in its proposed embodiments guarantees a rapid and precise positioning of curtains and like articles independently from the angular position of the curtain supporting roller.

This precision is guaranteed by the stabilizing action of the friction means, cylinders or spheres, which cooperate with the relative elastic means.

The compact and reduced structure of the barrel, equipped with a plurality of radial seats, allows to obtain a particularly strong locking mechanism, which is very reliable with a wide range of curtains and the like, thus permitting a substantial reduction of the number of sizes to be stored in magazine.

The possibility to easily stabilize the angular position of the sleeve by interaction of the elastic means with the relative friction means, makes the proposed mechanism very versatile, since it allows to work with almost constant dimensions, for different sizes of curtains and similar articles.

Moreover, it is to be pointed out that the number of the elements of the above described locking mechanism is limited and that they are very simple to manufacture, which is advantageous to the production costs.

It is understood that what above has been described as a mere, non limitative example, therefore possible constructive variants remain within the protective scope of the present technical solution, as described above and claimed in the following.

What is claimed is:

1. A mechanism for locking curtains comprising a sleeve rotating about a longitudinal axis and fastened to a roll, in coaxial relation therewith, a curtain rolled up on said roll, said mechanism being fastened to a stationary support structure, said mechanism also including:

a barrel which enters freely said sleeve and couples firmly with said sleeve and couples firmly with said support structure by coupling means, said barrel having made therein, at least one radial housing opening outside of said barrel; at least one longitudinal recess, made in the outer surface of said barrel and communicating with said radial housing;

at least one elastic element introduced freely in the radial housing and co-operating with friction means, said friction means being freely introduced into said longitudinal recess and said friction means being kept in contact with an inner surface of said sleeve due to the action of the friction means on the elastic element.

2. A mechanism for locking curtains comprising a sleeve rotating about a longitudinal axis and fastened to a roll, in coaxial relation therewith, a curtain rolled up on said roll, said mechanism being fastened to a stationary support structure, said mechanism also including:

a barrel which enters freely said sleeve and couples firmly with said support structure by coupling means;

a plurality of a series of radial housings made in said barrel, the housings of each series being aligned and opening outside of said barrel, corresponding axes of said housings being aligned in a longitudinal plane passing through a longitudinal axis of the barrel; at least one longitudinal recess, made in the outer surface of said barrel and communicating with at least one series of radial housings;

at least one elastic element introduced freely in each radial housing and co-operating with friction means, said friction means being kept in contact with an inner surface of said sleeve due to the action of the friction means on the elastic element.

3. The mechanism, according to claim 2, further including a plurality of longitudinal recesses, made in an outer surface of said barrel and communicating with the corresponding series of radial housings, said friction means being freely introduced into each longitudinal recess.

4. The mechanism, according to claim 2, wherein said longitudinal planes, on which axes of each series of radial housings lay, are equally spaced relative to each other.

5. The mechanism, according to claim 1, wherein a seat is made near an inlet of said sleeve, for receiving a flange of said barrel during the introduction of said sleeve.

6. The mechanism, according to claim 1, further including a drive member, provided on an outer side of said sleeve near an inlet thereof, for driving a transmission element, for rotating said sleeve with respect to said barrel.

7. The mechanism, according to claim 6, wherein said drive member is integral with the sleeve.

8. The mechanism, according to claim 2, wherein a seat is made near an inlet of said sleeve for receiving a flange of said barrel during the introduction of said sleeve.

9. The mechanism, according to claim 2, further including a drive member, provided on an outer side of said sleeve near an inlet thereof, for driving a transmission element, for rotating said sleeve with respect to said barrel.

10. The mechanism, according to claim 9, wherein said drive member is integral with the sleeve.

11. The mechanism, according to claim 1, wherein said friction means comprise at least one sphere made of rigid or semi-rigid material.

12. The mechanism, according to claim 1, wherein said friction means comprise at least one cylinder made of rigid or semi-rigid material.

13. The mechanism, according to claim 1, wherein said friction means comprise at least one cylinder made of rigid or semi-rigid material having a flattening, cooperating with said elastic means.

14. The mechanism, according to claim 1, wherein said elastic means comprise at least one spring.

15. The mechanism, according to claim 1, wherein the coupling means comprise a tang made in said support structure and entering a seating having a complimentary section, made in said barrel.

16. The mechanism, according to claim 1, wherein the coupling means comprise grooved profiles for a splined coupling made in said support structure and entering a seating having a complimentary section made in said barrel.

17. The mechanism, according to claim 1, wherein said barrel is composed of an anchorage body and an operative body, said anchorage body coupling with said support structure by the coupling means, and having a transversal slot made along an axial plane thereof, said operative body including the at least one radial housing and the at least one longitudinal recess therein and having a unit removably coupled with said transversal slot, said sleeve being formed by two bodies, a reference body and a support body respectively, said reference body being tightly wound around said anchorage body and removably coupled with said support body, which is freely winding around said operative body, at least one longitudinal groove made in one edge of said reference body coupling with a wing, of complementary section made in said support body.

18. The mechanism, according to claim 2, wherein said friction means comprise at least one sphere made of rigid or semi-rigid material.

19. The mechanism, according to claim 2, wherein said friction means comprise at least one cylinder made of rigid or semi-rigid material.

20. The mechanism, according to claim 2, wherein said friction means comprise at least one cylinder made of rigid or semi-rigid material having a flattening, cooperating with said elastic means.

21. The mechanism, according to claim 2, wherein said elastic means comprise at least one spring.

22. The mechanism, according to claim 2, wherein the coupling means comprise a tang made in said support structure and entering a seating having a complimentary section, made in said barrel.

23. The mechanism, according to claim 2, wherein the coupling means comprise grooved profiles for a splined coupling made in said support structure and entering a seating having a complimentary section made in said barrel.

24. The mechanism, according to claim 2, wherein said barrel is composed of an anchorage body and an operative body, said anchorage body coupling with said support structure by the coupling means, and having a transversal slot made along an axial plane thereof, said operative body including the at least one radial housing and the at least one longitudinal recess therein and having a unit removably coupled with said transversal slot, said sleeve being formed by two bodies, a reference body and a support body respectively, said reference body being tightly wound around said anchorage body and removably coupled with said support body, which is freely winding around said operative body, at least one longitudinal groove made in one edge of said reference body coupling with a wing, of complementary section made in said support body.

* * * * *